United States Patent [19]

Becker

[11] 4,374,536

[45] Feb. 22, 1983

[54] ENERGY SAVING WINDOW SCREEN GUIDE DEVICE

[76] Inventor: Sharon L. Becker, R.R. #2, SH 109, Delta, Ohio 43515

[21] Appl. No.: 184,285

[22] Filed: Sep. 5, 1980

[51] Int. Cl.[3] ..... E06B 3/94

[52] U.S. Cl. ..... 160/84 R; 160/40; 160/327

[58] Field of Search ..... 160/40, 41, 84 R, 124, 160/327, 345

[56] References Cited

U.S. PATENT DOCUMENTS

| | | | |
|---|---|---|---|
| 134,862 | 1/1873 | Donnell | 160 84 R/ |
| 1,172,174 | 2/1916 | Soule | 160/84 R |
| 1,482,059 | 1/1924 | Zimmer | 160/84 R |
| 2,396,295 | 3/1946 | Spraragen | 160/40 |
| 3,002,785 | 10/1961 | Larche | 160/327 |
| 3,055,419 | 9/1962 | Rubin et al. | 160/84 R |
| 3,857,432 | 12/1974 | Russell | 160/124 |
| 4,230,171 | 10/1980 | Baker, Sr. | 160/84 R |

OTHER PUBLICATIONS

Payne Safe-Snap Tape and Track, Jan. 22, 1959.

*Primary Examiner*—Peter M. Caun

*Attorney, Agent, or Firm*—Wilson, Fraser, Barker & Clemens

[57] ABSTRACT

The screen or shade for the window is of flexible material so that when in open position it can be pleated. Opposite sides of the screen have tapes sewed on near the edges and male snap fasteners are spaced from each other on the tapes. These fasteners snap into holes in plastic glides which travel along plastic tracks. Either converted by screws or integral with the tracks are angle sealing strips, one flange being on the outside and arranged to prevent air movement from the inside of the screen to the outside, or vice versa, when the screen is closed. Either attached by screws to the track and sealing strip assembly or integral therewith is a mounting rail which is attached by screws to the building or support. A slanting roof is shown having several windows equipped with independently glided screens.

8 Claims, 8 Drawing Figures

ENERGY SAVING WINDOW SCREEN GUIDE DEVICE

BACKGROUND OF THE INVENTION

Heretofore, it has been common practice to provide screens or shades for windows to prevent the infrared energy of the sun from entering the room and to militate against the loss of heat energy through the windowpane in cold weather. However, although these efforts have helped, they have fallen short of achieving any degree of efficiency, due to a large extent to the escape or leakage of air at the side edge portions of these screens. The body of the screens affords a good barrier for air flow, but the sides are open to relatively free flow and, as a result, a large loss of energy occurs.

SUMMARY OF THE INVENTION

A window covering or screen has at each side one operating and sealing assembly enabling the screen to be readily raised in corrugated fashion on glides riding along tracks which guide the upward and downward movements. Associated with the tracks are sealing strips so constructed and arranged as to prevent egress of air to or from the space between the screen and the window panel. Each track, sealing strip, and a mounting or attaching rail provide an assembly for installation. The parts may be of unitary construction and formed of plastic by extrusion molding. If desired, only the track and sealing strip may be of one piece for certain installations. The screens may be operated by hand with suitable cord and pulleys, although other devices for this purpose can be employed.

DETAILED DESCRIPTION OF THE PREFERRED EMBODIMENTS

Figure 1:
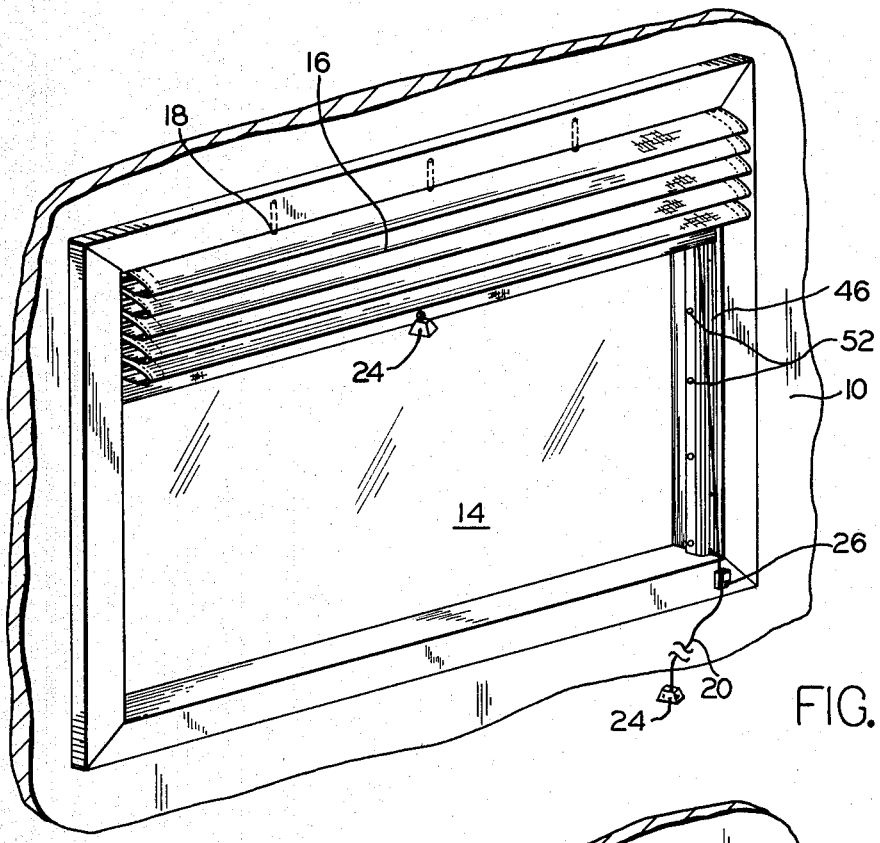
FIG. 1 is a perspective view of a window panel and a screen for same in raised position.
Figure 2:
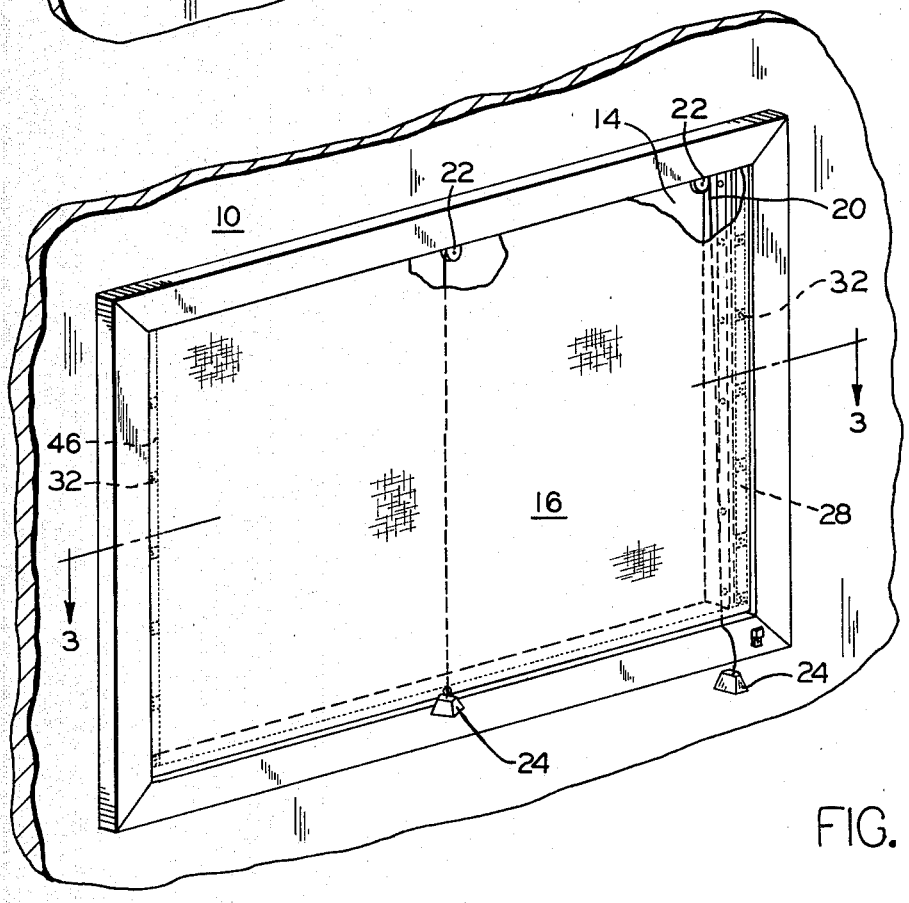
FIG. 2 is a view similar to FIG. 1 with a screen in lowered position.

Referring to FIGS. 1 to 4, a building structure 10 is provided with a window frame 12 having a glass panel 14. Secured to the top portion of the frame 12 by fasteners 18 is a flexible window screen 16 which is held in intimate engagement therewith. The screen 16 may be of any suitable flexible sheet material having the capability of folding pleat-wise and is typically opaque to effectively block out all or a major portion of the outside light. The screen 16 may be raised to uncover the window 14 by a cord 20 which rides over pulleys 22 and hand pulls 24 on the cord 20 to enable manipulation of the screen 16 in one direction or the other. A cord catch 26 is provided to retain the cord 20 to maintain the associated screen 16 in any selected position.

Figure 3:
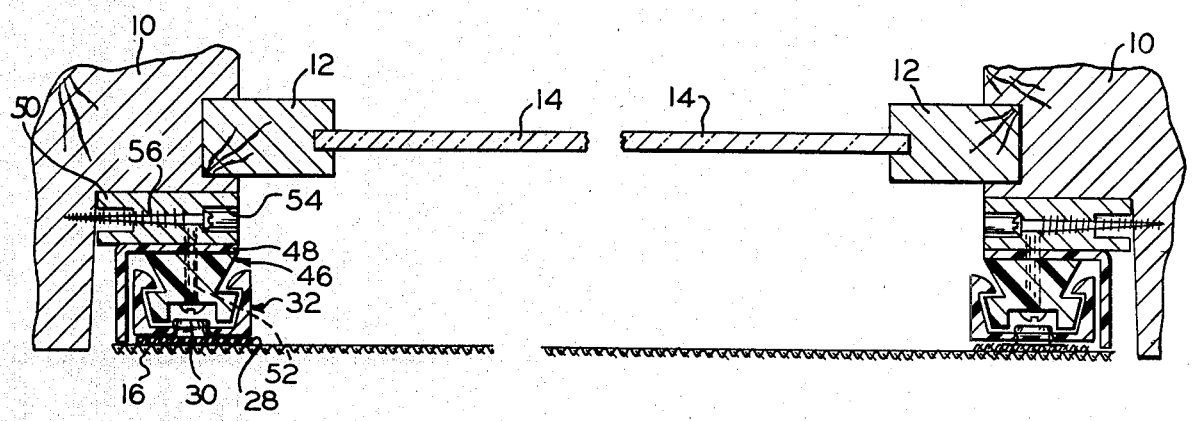
FIG. 3 is an enlarged fragmentary transverse sectional view on line 3—3 of FIG. 2.
Figure 4:
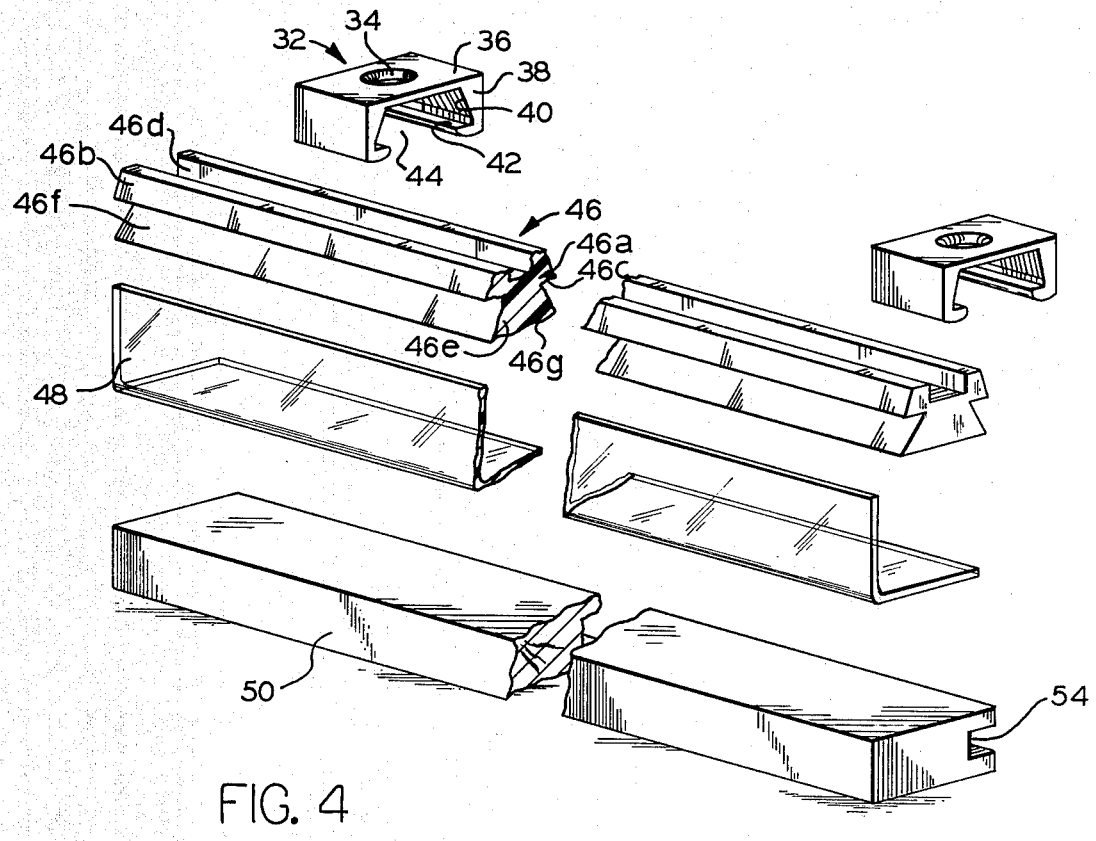
FIG. 4 is an enlarged perspective view of several parts of the screen actuating and sealing assembly in exploded relation.

Important features of the invention involve the guiding of the sides of the screen 16 to afford free and easy up and down movement and the sealing to militate against hot air between the window panel 14 and the adjacent surface of the screen 16 escaping into the associated building as well as the escape of warm air from the building. This provides a remarkable saving in energy, both in the summer time and in the winter time. For this purpose, an assembly is produced including a tape or web 28 of textile material suitably secured as by stitching, to each side edge of the screen 16. As shown in FIG. 3, the edge portion of the screen 16 extends slightly beyond the adjacent edge of the tape 28, and, as will hereinafter appear, a part of the assembly engages the projecting part of the screen 16 for air sealing purposes. On each tape 28 is a series of spaced metallic male snap parts 30 which project inwardly therefrom for engagement with a series of molded plastic guides 32. Each guide 32 has in its flat top wall 36 an aperture 34 through which the fastener 30 is forced, the plastic having sufficient flexibility to enable the fastener part 30 to be forced into the aperture securely to retain the glide 32 to the tape 28.

Depending from the top wall 36 of each glide 32 are side walls 38 provided with downwardly and outwardly inclined inner walls 40, each having an inwardly extending longitudinal ledge 42 forming therebetween a channel 44. The guides 32 slidingly fit an elongate, extruded plastic track 46 which may be of the desired length or may be joined to other track segments for the purpose. The track 46 has an upper portion **46*a* provided with outwardly flaring side walls 46*b* contoured to accommodate the inclined inner glide walls 40. The head or upper track portion 46*a* has oppositely disposed flat ledges 46*c* for sliding engagement by the ledges 42 of the glide 32. At the top of the track portion is a longitudinal groove 46*d* to receive the heads of attaching screws hereinafter explained. The lower portion 46*e* of the track 46 has opposite outwardly flaring walls 46*f* and a flat bottom wall 46*g***.

As shown in FIG. 3, the flat bottom wall **46*g* of the track 46 bears against the horizontal flange of an L-shaped plastic sealing strip 48, the other flange abutting the lateral projecting portion of the screen 16 to aid in preventing the movement of the air therebetween. The sealing strip 48 extends the entire length of the track 46 and effectively militates against air escaping to or from the space between the screen 16 and the glass panel 14. The horizontal flange of the sealing strip 48 abuts flatwise against a wooden mounting rail 50**.

The assembly above-described of the track 46, the sealing strip 48, and the wooden rail 50 are secured together as a unit by a series of screws 52, the heads of which are recessed in the groove **46*d* in the track 46. Thus, these parts provide a unit which can be easily installed in position of use at each side of a window screen and in intimate relationship to it. Each unit, thus far described, is adopted for securement to the recessed inner surfaces of the main window frame which supports the frame 12 of the glass panel 14 by a series of screws 56 in the rail 50 wherein the heads of the screws 56 reside totally within the channel 54** which extends the entire length of the mounting rail.

It will be understood that a similar assembly is positioned at each side of the window screen 16 so that by pulling on one or the other of the hand pulls 24, the screen may be raised to uncover the window panel 14, or alternatively cover it. The glides 32 which are spaced from each other an appropriate distance to insure satisfactory pleating of the screen 16, rides smoothly upon the track 46 in an almost frictionless manner. An outstanding feature of these assemblies is the angle sealing strip 48, one flange of which is disposed parallel to the screen movement and presents a barrier to the lateral movement of air to or from the space between the screen 16 and the associated window panel 14. Note in FIG. 3 that the edge portion of the screen 16 abutts and travels over the edge of the adjacent flange of the sealing strip 48. This affords a notable saving of energy, when in the closed position, due to the fact that cold air in winter, for example, is prevented from entering the associated building, as well as preventing heated air movement in the summer time therefrom. Accordingly, the assemblies not only afford easy operation of the screen 16 but also provide a distinct savings in energy consumption.

Figure 5:
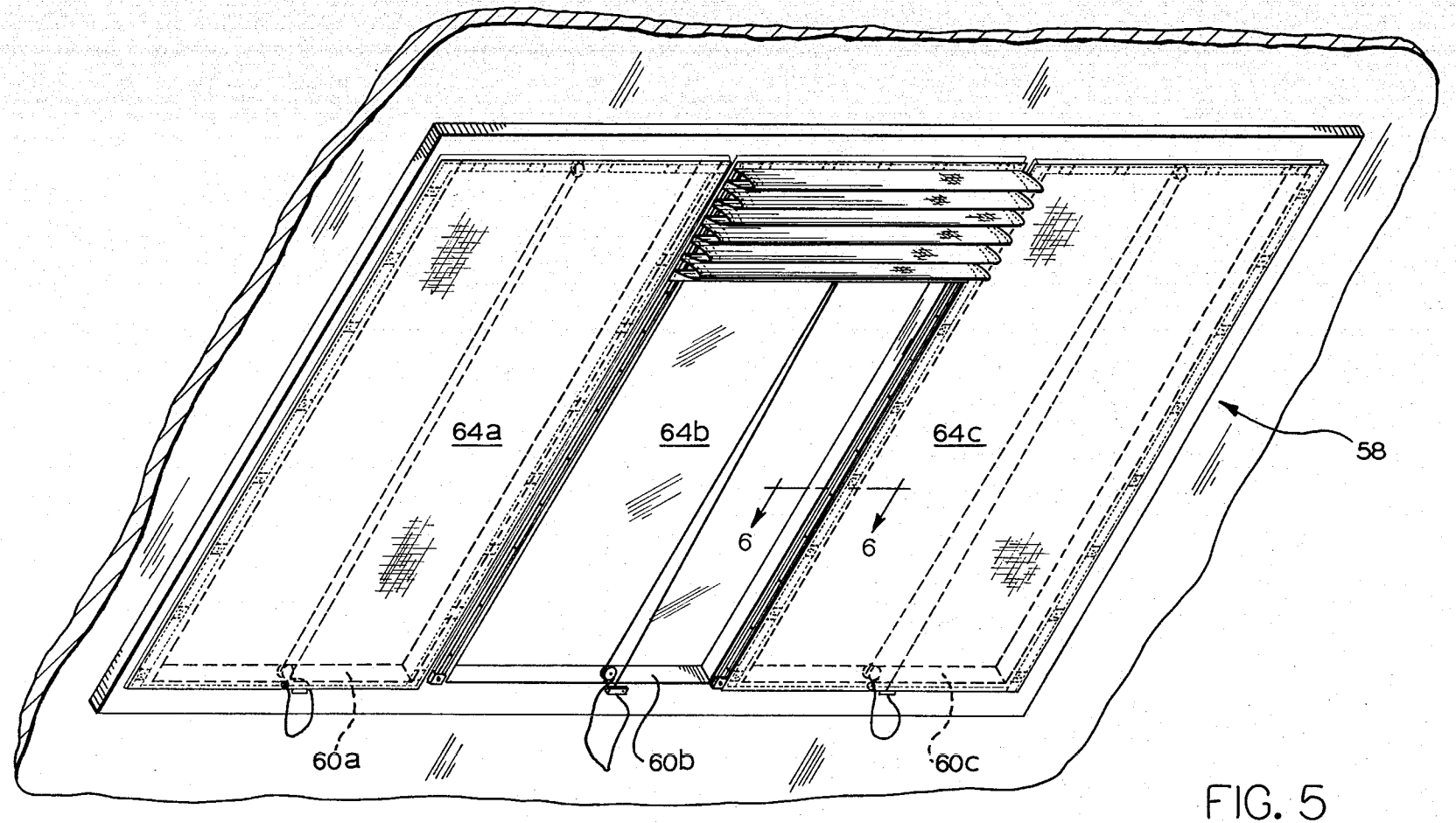
FIG. 5 is a perspective view of a plurality of window units in a roof equipped with covering screens and associated operating assemblies.
Figure 6:
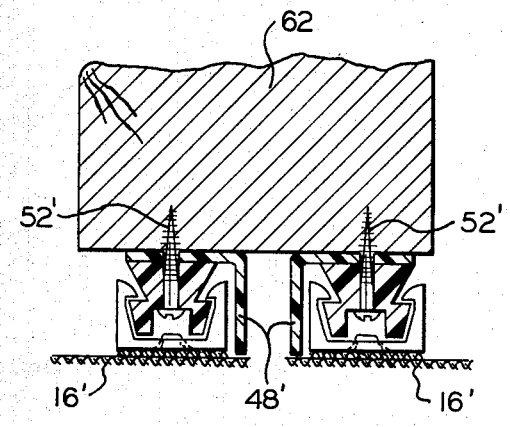
FIG. 6 is an enlarged fragmentary sectional view on the line 6—6 of FIG. 5.

FIGS. 5 and 6 show an alternate form of the invention in which the assembly is employed in a window arrangement formed in a roof 58. The roof 58, as illustrated, is provided with three adjacent window frames 60*a*, 60*b*, and 60*c*. On the inner side of the roof 58 and surrounding each of the respective window panels are wooden finishing strips 62. Typically the finishing strips 62 completely surround the perimeter of the window assemblies and extend between adjacent window frames. Flexible screens, indicated at 64*a*, 64*b*, and 64*c* are mounted as previously described so that further detailed description is not considered necessary. It is to be noted that the vertical flange of adjacent sealing strips 48' similarly engage the edge portions of the screen 16' for air trapping purposes and to effect energy saving. The assemblies are secured to the finishing strips 62 just as the other assemblies are attached to the rails 50. However, it will be noted that the arrangement illustrated in FIGS. 5 and 6 are employed for attachment directly to a planar surface, such as the finishing strip 62, in side by side relationship.

Figure 7:
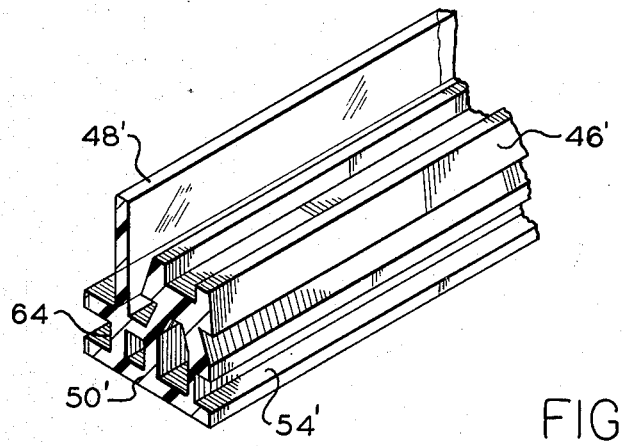
FIG. 7 is a fragmentary perspective view of an alternative form in which the track, sealing strip, and mounting rail are of unitary construction.

Instead of forming the assembly illustrated in FIGS. 1 to 4 in separate and individual elements, the parts may be incorporated into a single unitary structure and formed as a single extrusion molded plastic unit as illustrated in FIG. 7. In FIG. 7 the track is indicated at 46', the sealing strip at 48', and the mounting rail at 50'. The relationship of these parts is as above-described and the interfunctional relationship is identical. The rail 50' not only has a longitudinal recess or channel 54' in which the heads of the associated attaching screws are disposed, but also a channel 64 on the opposite side which not only reduces the amount of plastic material necessary to produce the product, but also reduces the distance the attaching screws travel through the plastic material and also effects the overall weight of the assembly.

Also, the main body portion of the unitary structure may be provided with hollow internal passageways which reduce the amount of plastic material necessary to fabricate the product, but function to allow air to pass therethrough to assist in preventing an undue build-up of heat in the product which might cause an undesirable warping and dimensional instability.

Figure 8:
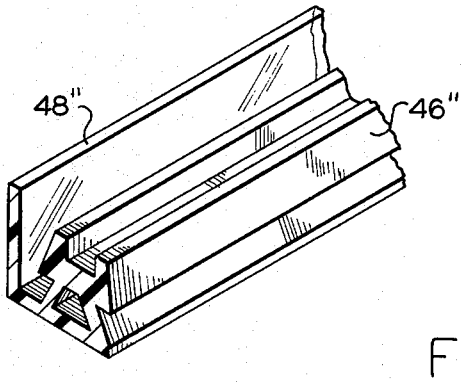
FIG. 8 is an enlarged fragmentary perspective view of an alternate form in which the track and sealing strip are of one piece, the mounting rail being omitted.

In FIG. 8, there is shown a further modification of the invention and more particularly illustrates a single unitary product, similar to the assembly illustrated in FIGS. 5 and 6, wherein the track 56'' has an integral sealing strip 48'', disposed in laterally paralled relation. This form of the invention is for flush mounting as illustrated in FIGS. 5 and 6.

Numerous changes in details of construction, choice of materials, and features of operation may be made without departing from the invention particularly as defined in the appended claims.

What I claim is:

1. In a window opening having frame members defining the opening and containing the marginal edges of a transparent panel and a flexible screen for covering and uncovering the panel, the improvement comprising:

longitudinally extending track means mounted to extend in parallel spaced relation along at least two parallel spaced apart members of the window opening, said track means having longitudinally extending grooves;

guide means being received by the grooves of said track means enabling said guide means to slide along the longitudinal axis of said track means;

longitudinally extending seal means mounted to extend substantially the entire length of said track means, said seal means including a substantially continuous sealing strip positioned on the outer side of said track grooves and said guide means, said sealing strip having an outer marginal edge and an inner marginal edge, the inner marginal edge secured to said track means and the outer marginal edge terminating in spaced parallel relation to said track means; and means connecting at least two longitudinally spaced apart edge portions of the screen to respective guide means, said connecting means being spaced inwardly from the associated marginal edge of the screen for effectively causing the associated marginal edge of the screen to extend outwardly past said associated track means and abut against the outer marginal edge of said sealing strip to militate against the flow of air therethrough.

2. The invention defined in claim 1 in which said sealing strip consists of an angle member, one flange of which is connected to said track means and the other flange of which is disposed on the outer side of said track means for preventing lateral air flow therethrough.

3. The invention defined in claim 2 wherein said track means and seal means are of unitary construction.

4. In a window opening having frame members defining the opening and containing the marginal edges of a transparent panel and a flexible screen for covering and uncovering the panel, the improvement comprising:

longitudinally extending track means mounted to extend in parallel spaced relation along at least two parallel spaced apart members of the window opening, said track means having longitudinally extending grooves;

guide means being received by the grooves of said track means enabling said guide means to slide along the longitudinal axis of said track means;

longitudinally extending seal means mounted to extend substantially the entire length of said track means, said seal means including a substantially continuous sealing strip having an outer marginal edge and an inner marginal edge, the inner marginal edge secured to said track means and the outer marginal edge terminating in spaced parallel relation to said track means, said sealing strip consisting of an angle member, one flange of which is connected to said track means and the other flange of which is disposed at one side of said track means;

a mounting rail engaging one flange of said sealing strip and connected thereto; and means connecting at least two spaced apart marginal edges of the screen to respective guide means, said connecting means effectively causing the associated marginal edge of the screen to abut against the outer marginal edge of said sealing strip to militate against the flow of air therethrough.

5. The invention defined in claim 4 including channels in said track means for receiving threaded fasteners.

6. The invention defined in claim 5 in which said mounting rail is disposed beneath said track means and said seal means, and said rail, track means and said seal means are of unitary plastic construction.

7. The invention defined in claim 6 wherein said rail is provided with channels at opposite sides, a series of screw receiving holes between said channels, the heads of the screws lying in one channel and the other channel reducing the length of screw travel through the wall as well as amount of plastic material required to form the structure.

8. The invention defined in claim 6 wherein unitary plastic construction is provided with internally extending passageways.

* * * * *